United States Patent [19]

Traudt

[11] Patent Number: 5,003,865

[45] Date of Patent: Apr. 2, 1991

[54] PRESSURE CONTROLLED FRESH AIR SUPPLY VENTILATION SYSTEM SOIL GAS PRESSURE AS A REFERENCE, AND METHOD OF USE

[76] Inventor: Jon E. Traudt, 3316 Augsta, Omaha, Nebr. 68144

[21] Appl. No.: 457,406

[22] Filed: Dec. 27, 1989

[51] Int. Cl.[5] ..... F24F 11/04

[52] U.S. Cl. ..... 98/1.5; 98/34.6

[58] Field of Search ..... 52/169.1, 169.5; 98/1.5, 31.5, 31.6, 33.1, 34.5, 34.6

[56] References Cited

U.S. PATENT DOCUMENTS

| | | | |
|---|---|---|---|
| 3,611,906 | 10/1971 | Lorenz | 98/33.1 |
| 4,043,256 | 8/1977 | VanHuis | 98/1.5 |
| 4,257,318 | 3/1981 | Johannsen | 98/1.5 |
| 4,407,185 | 10/1983 | Haines et al. | 98/1.5 |
| 4,483,273 | 11/1984 | Develle et al. | 98/1.5 X |
| 4,489,881 | 12/1984 | Dean et al. | 98/1.5 X |
| 4,552,058 | 11/1985 | Wooldridge | 98/1.5 |
| 4,620,398 | 11/1986 | Wallin | 52/169.1 |
| 4,705,066 | 11/1987 | Gut et al. | 98/1.5 X |
| 4,717,402 | 1/1988 | Lutterbach et al. | 98/33.1 X |
| 4,773,309 | 9/1988 | Walters | 98/31.6 |
| 4,781,107 | 11/1988 | Nilsson | 98/1.5 X |
| 4,843,786 | 7/1989 | Walkinshaw et al. | 98/31.5 X |
| 4,850,264 | 7/1989 | Kiser | 98/1.5 |
| 4,905,579 | 3/1990 | Dame | 98/1.5 |

FOREIGN PATENT DOCUMENTS

| | | | |
|---|---|---|---|
| 3638-015 | 5/1988 | Fed. Rep. of Germany | 98/1.5 |
| 590556 | 1/1978 | U.S.S.R. | 98/1.5 |
| 111099 | 7/1984 | U.S.S.R. | 98/1.5 |

OTHER PUBLICATIONS

"Radon Reduction Techniques for Detached Houses", *Technical Guidance,* EPA/625/5-86/019, U.S. Environment Protection Agency, Jun. 1986.

EPA/625/5-87/019, Revised Jan. 1988, "Radon Detection Techniques for Detached Houses", Bruce Henschel, pp. 153 and 154.

"EPA Indoor Air Pollution Report Calls for More Federal Research", *National Geographics,* 4/87, p. 259.

*Primary Examiner*—Harold Joyce

*Attorney, Agent, or Firm*—James D. Welch

[57] ABSTRACT

A ventilation system and the method of its use, the ventilation system is typically, though not exclusively, used with tight houses or buildings in which many of the cracks which can allow air and contaminates to randomly enter and exit have been sealed. The ventilation system allows for a user adjustable minimum flow of outside air volume flow rate into the house or building, and provides for automatic adjustment of the outside air volume flow rate into the house or building to maintain the air pressure inside the house or building at a level which is determined by reference to the relatively constant soil gas pressure beneath the house or building.

5 Claims, 1 Drawing Sheet

PRESSURE CONTROLLED FRESH AIR SUPPLY VENTILATION SYSTEM SOIL GAS PRESSURE AS A REFERENCE, AND METHOD OF USE

TECHNICAL FIELD

The present invention relates to house and building ventilation systems and their methods of use, and more particularly to pressure controlled houses or buildings and a ventilation system which utilizes the soil gas pressure below the houses or buildings as a reference pressure, to which house or building inside air pressure is compared by the system during operation. The outside air volume flow rate into a house or building is controlled based upon an initial user set value of desired outside air volume flow rate, which set level of outside air volume flow rate is, under normal conditions, then adjusted by ventilation system action to counteract changes in a signal derived by comparison of said soil gas and inside house or building air pressures, in a pressure comparison device.

BACKGROUND

The quality of air in houses and buildings is subject in a recently released Environmental Protection Agency Report titled "EPA Report to Congress on Indoor Air Quality", released Aug. 4, 1989. In that report reference is made to the so called "Sick Building Syndrom" and a program of increased research and information dissemination regarding the dangers of poor indoor air quality are recommended. Health effects attributed to poorly ventilated houses and buildings range from eye, ear, nose and throat irritation, to full scale respiratory and neurological diseases, genetic mutations and cancer. Contaminates such as radon, asbestos, tobacco smoke, formaldehyde, volatile organic compounds, chlorinated solvants, biological contaminants and pesticides etc., and the synergistic effects of multiple contaminants are cited as causes of health problems.

The report suggests that controlling the sources of contaminant is the most direct and dependable option in overcomming the problem, and that while air cleaning equipment can compliment air quality improvement, there is no substitute for providing an adequate ventilating outside air volume flow rate through a house or building.

In recent years, the high cost of energy has led many people to strive to make their houses and buildings more tightly sealed, hence, in combination with the use of insulation, more energy efficient. Said efforts have included sealing cracks and other openings in their houses or buildings to prevent heated or cooled air from escaping, and outside air which requires heating or cooling, from randomly entering at an excessive rate. In effect, such houses and buildings become, to various degrees, closed systems. In such structures the inside air turn over rate is often reduced to far below the American Association of Heating, Refrigeration and Air Conditioning Engineers presently recommended outside air volume flow rate of 15 Cubic Feet per Minute (CFM) per inhabitant, or 35% air change per hour, whichever is greater, (see ASHRAE Standard 62-1989). The result of an insufficient air volume flow rate into, and out of, such tight houses or buildings is that contaminates accumulate inside same to dangerous health affecting levels. The savings in energy costs become less significant, and might be expected to be surpassed, over time, by increased health care costs. To emphasise this point, it is estimated by some health care researchers that presently two non-smoking persons per hour, in the United States alone, contract lung cancer as a result of contact with radon in poorly ventilated houses and buildings.

Given that, aside from the potential health hazards, making houses and buildings more energy efficient is desirable, then it follows that a method which would provide a sufficient health maintaining ventilation air volume flow rate to a tight structure would be of great benefit. A search of existing Patents shows that numerous inventors have realized this and have proposed systems, and methods of their use, which provide controlled ventilation to houses and buildings. The various approaches basically utilize a source of air flow, such as a motor driven blower, to cause air to move into and out of a house or building. The air volume flow rate is typically, but not necessarily in the most basic schemes, controlled based upon signals developed by sensing air pressure differences between the inside and the outside of a house or building, from signals derived from sensed rates of air flows in various parts of a system, or by sensing the velocity of the wind outside the house or building.

The most basic schemes simply provide a large air volume flow rate into a house or building sufficient to raise air the pressure inside the house or building to a large positive value with respect to that outside the house or building. In such a scheme the air volume flow rate must be large enough to maintain the large positive pressure difference no matter what active or passive exhaust air flows develop. As an example, operating a cloths dryer or fireplace will actively force exhaust air from a house, and opening a door to the outside of the house or building can passively increase exhaust air. The problem with such simple large positive pressure systems is that they are wasteful of energy. The large volume of air which is flowed into a house or building equipped with such a system must be heated or cooled continuously. As very large air volume flow rates are not necessary to keep contaminant concentration levels low enough for health maintenance reasons, there is no valid reason to provide them to a tight house or building. Inventors have noted this and responded. For instance, Lorenz, in U.S. Pat. No. 3,611,906 and Van Huis in U.S. Pat. No. 4,043,256 teach systems which sense inside and outside air and from same develop signals which are used to control the amount of air volume flow rate through a house or building, based upon the difference in said signals. That is, the flow of air into and out of a house or building is modified as required, by use of inlet air or exhaust air fans, to dynamically keep the inside air pressure above that outside the house or building. The problem with such schemes is that outside air pressure is used as a reference, and because of quickly occurring wind induced changes, that reference is not particularly constant. A Russian Patent to Slavin et al., No. SU-590-556 teaches a system which goes some distance toward overcoming this defect by sensing wind velocity and combining a wind volocity derived signal with an outside atmospheric pressure derived signal, which combined signal is used as a basis to control air volume flow rates. The problem still remaining is, however, that the wind can change very quickly and control systems tend to become unstable when a reference signal changes quickly. A Patent to Johannsen, U.S. Pat. No. 4,257,318 recognizes that a constant reference signal is necessary to assure stability in a control system, and Johannsen focuses on the use of a user set reference signal level to which are compared numerous air pressure representing signals, which air pressure representing signals are produced by sensors in various locations in air ducts in a house or building. The Johannsen approach selects the lowest such sensed air pressure representing signal and that signal is compared to the user set reference signal. Air volume flow rate is controlled based upon the signal resulting from the comparison. The Johannsen invention also provides for adjustable dead bands in the comparison circuitry to enhance stability. The problem with the Johannsen system is that, just as in the most basic large positive pressure schemes, the selected reference signal has no definite relationship to any relevant reference pressure, hence, the air volume flow rate can be unknowingly set to energy wasting levels which are higher than necessary to provide a healthy environment inside a house or building, over time. A Patent to Haines et al., U.S. Pat. No. 4,407,185 teaches the sensing of pressure in a plenum system and controlling air volume flow rates so that said pressure is typically maintained at a negative value with respect to outside air pressure. As a result outside air flows into the plenum. The reference signal is, however, derived from outside air pressure by a sensor which is exposed to wind, and thus the signal can be rapidly changed by wind, as has already been noted. It is added that while retaining a negative pressure in a plenum is an acceptable way to draw air into same, keeping a negative pressure in a house or building can lead to, for instance, flue gases can be trapped in a house or building by air being drawn down through a chimney. The results can be deadly. A Patent to Dean et al. teaches a system for use in hospitals. An air volume flow rate controlling signal is derived from the difference between air pressure signals derived by sensors located in a hospital room and in the hall outside the hospital room. An air volume flow rate is set, based upon the difference in said signals, which is sufficient to keep a positive or negative pressure in the room with respect to the pressure in the hall. While the pressure in the hall of a hospital will be relatively more constant than that outside the hospital, it will still change when doors are opened or closed etc. Again the reference pressure is variable.

It will be appreciated that the systems surveyed above provide air volume flow rate supplies which use reference signals which are simply set arbitrarily, or which are derived based upon references signals which are not relatively constant. As well, the basic approach is to provide air volume flow rates which are sufficient to keep a significant pressure differential in place. In either case the air volume flow rates provided will, over time, be in excess of what is actually needed to provide a "just adequate" ventilation, from a health maintenance perspective.

A need exists for a ventilation control system which identifies and utilizes a relatively constant pressure reference from which a signal can be derived, deviations from which signal can be used to control the air volume flow rate into, and out of, a house or building. Additionally, a need exists for a ventilation control system which does not typically maintain an excessive positive or negative pressure in a house or building, or part thereof, in excess of that which is just necessary to provide an adequate health maintaining, ventilation air volume flow rate into, and out of, the house or building, so that indoor air contaminant concentrations are kept below dangerous levels.

DISCLOSURE OF THE INVENTION

The need identified in the Background discussion is met by the system and method of the present invention. The present invention identifies an approach to house and building ventilation control which is new, novel and different from that taught in all prior art of which the inventor is aware. The present invention identifies the "soil gas pressure" beneath a house or building as a source of a relatively constant control system reference signal, and teaches that air volume flow rate into, and out of, a house or building should be controlled such that the pressure inside a house or building, (or some aspect thereof), equipped with the new invention system, is typically kept essentially in balance with said soil gas pressure, rather than at some large positive, (or negative), level with respect thereto. Note however, it is not beyond the scope of the present invention to operate the present invention system with the house or building inside air pressure at a positive or negative pressure with respect to the soil gas pressure. This is further discussed in the Detailed Description Section.

So that the discussion herein might be better understood, it is, at this point, noted that "Atmospheric" pressure outside houses or buildings averages 14.7 pounds per square inch at sea level and results from the weight of the air in Earth's atmosphere acting downward on the Earth's surface. Of course this value varies with changes in weather systems, altitude and atmospheric pressures higher or lower than 14.7 pounds per square inch are common. Typically, however, atmospheric pressure changes slowly. "Air" pressure outside houses or buildings, however, can change quickly as a result of air moving essentially parallel to the Earth's surface, which air movement is commonly termed wind. As noted in the Background Section, it is the quick changes in air pressure outside houses or buildings which make said outside air pressure less than optimum for use in deriving a reference signal for use in air volume flow rate controlled ventilation systems.

Continuing, it will be appreciated that a major health endangering source of contamination in tight houses or buildings is radon gas which leaves the ground soil beneath a house or building, when the pressure inside the house or building is less than the soil gas pressure, which radon can and often does, accumulate in said house or building because of insufficient ventilation therein. Radon gas is a product of the disintegration of uranium in the soil, and it is continually produced and released to the atmosphere along with other gases from the soil. When a blockage to said release, such as the presence of a house or building, is present, a pressure, the "soil gas" pressure, is developed beneath the house or building. The present invention provides that the pressure inside a house or building should typically be controlled to just match and oppose the pressure exerted by soil gas in the soil beneath a house or building, thereby neutralizing the tendency for soil gas to enter the house or building. It is also noted that over time, on the average, soil gas pressure is slightly greater than atmospheric pressure outside houses or buildings, hence, on the average, if the pressure inside a house or building is kept essentially at that of the soil gas pressure beneath the house or building, the pressure inside the house or building will be slightly in excess of outside atmospheric pressure. The result is that air inside the house or building with the system of the present invention installed therein will have a tendency to passively leave the house or building as is the case with the positive pressure, (with respect to outside air pressure), systems identified in the Background discussion. While it is recognized that the average atmospheric pressure outside a house or building, over time, is lower than soil gas pressure, wind induces instances where a very brief inversion in the relationship can intermittantly take place. In such cases the outside air pressure on the upwind side of a house or building can become greater than air pressure inside said house or building. The present invention system does not attempt to quickly respond to signals from a sensor exposed to wind and adjust air pressure inside a house or building in response, such as do many of the inventions which are discussed in the Background Section. A recommendation in the present approach to ventilation control is that the house or building using the system and method be made as tight as is economically practical. That is as many cracks and other openings as is economically practical, except for appliance and fireplace etc. air exhaust vents are sealed to minimize the amount of air which can randomly enter or infiltrate the house or building when outside wind pressure momentarily exceeds the air pressure level maintained inside the house or building. New houses and buildings can be constructed so that essentially no cracks exist. In existing houses and building, however, varying levels of "tightness" are achieved from efforts to seal cracks. As a result, the term "tight" is to be interpreted to represent a spectrum of situations extending from low to high as regards existing air leakage pathways in a house or building. To help with the understanding of the concept of a tight house or building one can consider that in a tight house or building the act of bringing in a minimum safe level of outside air for the number of occupants will typically cause the indoor air pressure to be greater than the soil gas pressure. The reason tight structures are preferred in practicing the present invention, is that air entering the house or building with the system of the present invention installed therein, predominately enters through a provided inlet air duct system. Included in said inlet air duct system will typically be located a high efficiency particulate air filter which serves to minimize the airbourn particulate contaminates inside a house or building. Also, as discussed supra, it is within the scope of the present invention, but not essential thereto, to place check valves on all exhaust vents in the house or building to allow air to leave the house or building, but not enter, to aid with this effect.

In operation, a user will select a setting on a control panel which will cause a base amount of air volume flow rate, (e.g. 15 CFM per occupant or 35% air change per hour), into the house or building via the air inlet duct system. The setting, as alluded to infra, will typically, but not necessarily, be restricted to values which cause the air pressure inside a house or building to normally just neutralize or just slightly exceed the soil gas pressure. The system will also provide for automatically increased air volume flow rates when, for instance, air is exhausted from the house or building as a result of the operation of appliances, (e.g. cloths dryer, or a fireplace etc.). The increased air flow will typically be controlled to be just sufficient to maintain essential equality of the air pressure inside the house or building with the soil gas pressure. Hence, the air pressure inside the house or building will typically be neutralized with respect to a relatively constant reference pressure. It will be appreciated that the control system of the present invention will not be subjected to wind effected quickly changing, stability threatening, reference pressure levels, but will rather operate based upon a relatively constant reference pressure level representing signal, which relatively constant reference pressure level representing signal is directly related to the soil gas pressure. Note that a tight house or building may also be an energy efficient house or building if proper insulation is provided.

It should be noted that optimum practice of the present invention requires that essentially as many cracks as possible which can allow random entry or exit of inside air into or out of a house or building be sealed to provide a tight structure. There remain, however, open passive exhaust air vents in the form of vents through appliances and fireplaces and the like, in addition to cracks which can not be sealed. No special active exhaust vent is therefore necessary in the practice of the present invention, although it is not beyond the scope of the present invention to provide a separate active exhaust device such as a blower or air pump where inlet and outlet air flows require balancing. In addition, the use of air dampers or valves to control air volume flow rate are within the scope of the present invention.

Also, as alluded to infra, it is within the scope of the present invention, but not essential thereto, to equip the open exhaust air vents with check valves which allow air outflow but not air inflow. This can be important, when for instance, outside upwind air pressure momentarily exceeds soil gas pressure due to intermittant wind pressure, and therefore, typically, house or building inside air pressure. Air will, under said conditions, tend to naturally passively enter the house or building if openings exist in upwind areas of the house or building. It is preferred that said air enter through the provided air inlet duct system wherein, as mentioned, will normally be placed a high efficiency particulate air filter. Should air enter, say, through a fireplace chimney instead, flue gases can be trapped in the house or building, the results of which can be deadly.

As well, the present invention provides that the inlet air duct system will normally feed into the cold air return of the heating and air conditioning system of a house or building, thereby making the system of the new invention relatively simple and economical to install. That is, a minimum of new equipments and house or building structural modifications are required to practice the invention.

The new system, thus, provides ventilation to a house or building which is adjustable by a user and which is just sufficient to provide a healthy environment therein. The present invention does not require that air inlet to a house or building, which must be heated and cooled, exceed a volume flow rate in excess of that which is just sufficient to provide said healthy environment. The present invention also identifies and utilizes a stable reference pressure, that being soil gas pressure, unlike the many inventions taught in prior Patents which sense the outside air pressure, hence, control system instability problems which exist in prior Patent systems as a result of attempting to track a quickly changing wind affected reference signal, are essentially eliminated in the present invention. It should also be noted tha the soil gas pressure is typically greater than the atmospheric pressure. Soil gas pressure includes radon and other gasses which emminate from the earth. A house or building typically restrains, but does not stop the flow of soil gas into and around the house or building. The difference in pressure between the soil gas under a house or building, and atmospheric pressure is typically small and relatively constant, even during windy days. Wind does not significantly affect soil gas pressure under a typical house or building, because to do so, wind would have to blow downward on all sides of the house or building simultaneously.

DETAILED DESCRIPTION

The average American home is not "tight" and as a result is very energy inefficient. Construction techniques leave numerous openings or cracks, (here-in-after referred to as cracks), through which air can randomly enter and/or leave. Typically door and window fittings, pipe penetrations, garage and roof attachments and imperfections in walls etc. provide a combined large area of leakage through which air can and does pass, (e.g. hundreds of square inches per house on the average). Not only do such cracks allow outside air to enter, which outside air must then normally be heated or cooled to provide comfort to those who inhabit the house, they also allow dust, pollen and numerous other contaminates access at random locations in the house. The result, in combination with the entry of radon gas via cracks in the house foundation, can be a very unhealthy inside environment. Contaminant can accumulate, unnoticed, to dangerous concentration levels and cause serious health problems. Some dangerous air contaminates have a detectible odor but some have no odor, taste or color. It is interesting to note that many contaminate induced illnesses are blamed on the flu germs, stress, and other causes. In most American houses the levels of contaminant are reduced naturally only when wind conditions cause an adequate volume of outside air flow to enter, and stale air to leave the house via the cracks and/or open doors and windows etc. However, such windy days do not occur based upon the need for contaminate removal from specific houses, and when they do occur they can cause a flow of air volume through the house in excess of, or less than that, required to optimally remove accumulated contaminant. An excess volume of air must, of course, normally be heated or cooled and is thus wasteful of energy. A flow of air volume less than required to remove the contaminant is, of course, potentially costly because of increased health care expenses.

Figure 1:
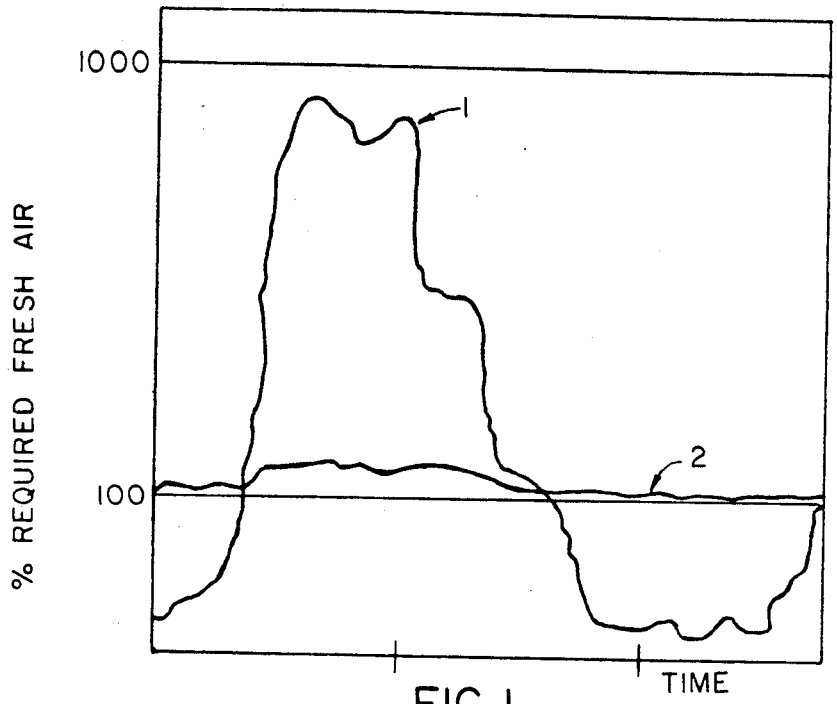
FIG. 1 is a graph showing, in curve 1, a typical volume flow of air into a house or building which has cracks therein which allow random entry and exit of air; and in curve 2, a typical volume flow of air into a house in which the cracks have been essentially all filled and in which ventilation air is provided by way of the present invention. Both curves are given as a percentage of that volume of air flow just required to provide a healthy environment inside the house or building.

FIG. 1 is a graph which exemplifies the situation. Curve 1 is a representation of house ventilation as a percentage of that which is optimally required to make the inside air of the house healthy, based upon the natural occurance of wind. Curve 2 shows a similar, but greatly superior, result such as that provided by the present invention. It will be appreciated that Curve 2 supplies a just sufficient air volume flow rate through a house to keep the inside air healthy and to supply make-up air to replace air removed from the house by kitchen exhaust systems, clothes dryers etc. Only the amount of air, or slightly more than that amount, required to adequately flush out contaminates at any given time is entered into the house, and only that amount of air must then be heated or cooled. Said basic air volume flow rate can be set by a user of the present invention, and the system of the invention will then automatically vary said level of air volume flow rate into the house to compensate for air which is exhausted from the house, as is further described in the following.

In recent years many people have become aware of the savings which can be achieved by reducing the cracks in their houses, and hence, the amount of randomly entering air which must be heated and cooled. Many people have sought to make their houses air, hence, energy "tight" by sealing such cracks. The result, while probably reducing the amount of energy which must be expended to heat and cool such a house, can cause contaminants to accumulate to dangerously high, health endangering, levels because of a lack of adequate ventilation, even on windy days. That is, if most of the cracks are sealed, even strong winds can not enter the house as they did before the house was made tight, and adequately remove contaminant by ventilation. High levels of contaminates can and do, according to present data, cause health problems which can cost more to treat than is saved by the reduction in energy consumption requirements as a result of sealing cracks.

While it is desirable to reduce energy costs associated with operating a house, it is dangerous to simply make one's house tight by sealing cracks. One must, in addition, provide a sufficient source of controlled ventilation air volume flow rate to assure that contaminant are swept from the house as required to keep their concentrations within healthy limits. The present invention provides a controlled source of ventilation air volume flow rate which is just sufficient to maintain a healthy environment inside the house.

Figure 2:
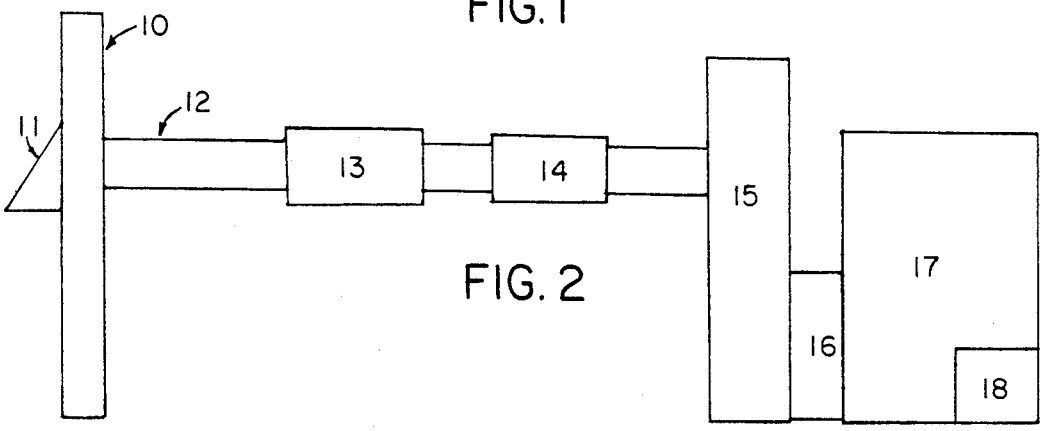
FIG. 2 shows, in block diagram form, the basic components typically present in the inlet air supply and existing furnace and air conditioning system of a house or building when the present invention is present.

The basic elements of the present invention are shown in FIG. 2. There is shown an inlet air duct system (12) which enters a house through an outside wall (10). A rain guard (11) is shown protecting the duct system (12) where it enters the house, but said rain guard does not obstruct the entry of air. The inlet air duct system (12) has integrated therein a prefilter (13) and an inlet air blower or air pump, (here-in-after referred to simply as inlet air blower), (14). Typically the duct system (12) will be installed so that it enters the cold air return system (15) of a house heating and cooling system so that incoming air can be heated or cooled before reaching the occupants. As well, a high efficiency particulate air filter, (16), (e.g. Honeywell Model F50), is preferably placed between the cold air return

(15) and the entrance to the furnace and air conditioning system (17). Said heating and air conditioning system (17) will contain a blower fan (18) which circulates heated or cooled air throughout the house, including the air entered through the inlet air duct system.

In use the blower fan (18) in the furnance and air conditioning system (17) is set to operate at a low constant speed unless the air passing through said blower fan (18) is to be heated or cooled. In that case the blower fan (18) will operate at the speed which is standard when the present invention is not in place. The result, it will be appreciated, is that mixed inlet and existing recirculation inside air is continually filtered to remove airbourn particles as it is circulated throughout the system of the house. However, when cracks in the house are sealed, very little air will randomly enter at various unintended locations in the house. The amount will, of course, depend on how many cracks remain. Inlet air volume flow rate is thus, very nearly completely, in a very tight house, controled by the inlet air blower (14) in the inlet duct system (12).

The inlet air blower (14) integrated into the present invention duct system is set to operate at a speed which causes some base level of air volume flow rate to be entered into the cold air return system (15) of the house heating and cooling system continuously, passing through the high efficiency particulate filter (16). This base level air volume flow rate is set by a user and can be varied within a certain range. The base level of outside air volume flow is set by the occupants of a house so as to provide a healthy environment inside the house under normal conditions, (e.g. 15 CFM per occupant or 35% air change per hour). Under normal conditions air will then enter the house by way of the invention inlet duct system (12), at location (11), and then be filtered by prefilter (13) and then by high efficiency filter (16), then flow through the house by way of the furnace and air conditioning system (17) and then exit, typically, through a fireplace chimney, or other natural passive exhaust outlet. However, most houses today have appliances which cause air to be exited from a house when operated. For instance, the typical cloths dryer will exit approximately 100 CFM. A kitchen or bathroom exhaust fan will exit approximately 80 CFM. A Jenn-Aire Range will exit approximately 240 CFM during operation and a fireplace in which a fire is built will cause approximately 30 to 120 CFM of air to exit a house.

Figure 3:
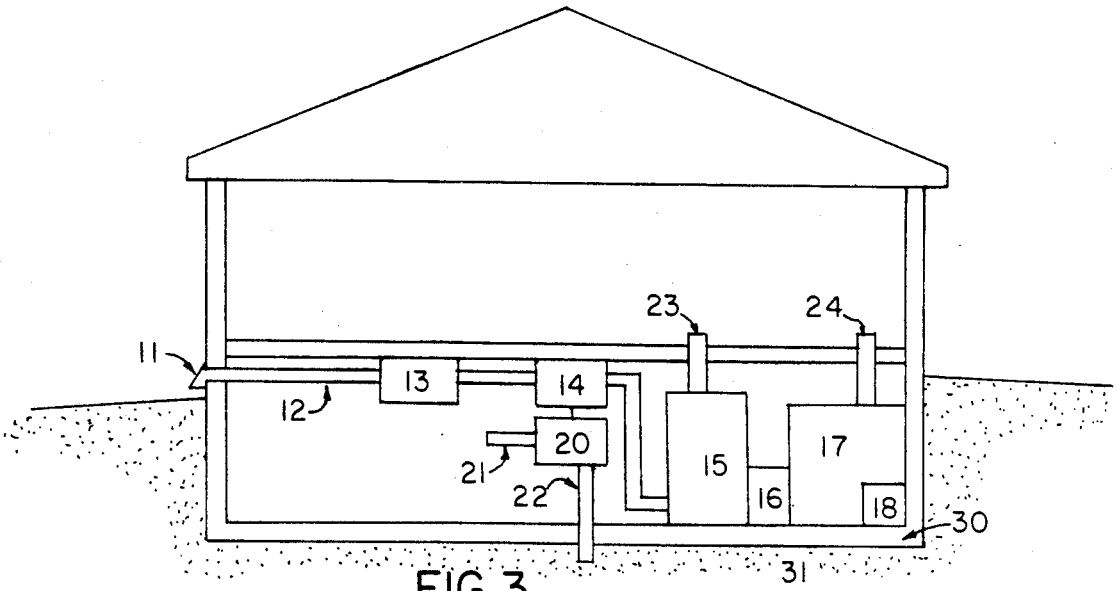
FIG. 3 shows, in block diagram form, the components shown in FIG. 2, but in a house setting, and additionally including representation of a pressure sensing device which senses the air pressure inside the house or building and the soil gas pressure beneath the house or building, and develops a signal based upon a comparison of said sensed pressures, which signal is used to control the air volume flow rate in the ventilation system so as to maintain a relationship between air pressure inside the house or building and the soil gas pressure selected by a user of the system.

Referring now to FIG. 3, it is seen that the present invention provides a device (20), (e.g. a pressure difference monitoring sensor such as Dwyer Instruments Model No. 3000-60PA), into which tubes (21) and (22), or an equivalent pressure location access providing means, are placed. The open end of tube (21) or equivalent is typically placed in the basement of the house and the open end of tube (22) or equivalent is placed through a hole in the foundation (30) of the house at which position it senses the soil gas pressure. Said hole is then sealed so that the tube (22) or equivalent is tightly gripped and so that soil gas can not escape around the outside of said tube (22) or equivalent. Also shown are a representation of normal house cold air return system elements (23) and a representation of normal house heated or cooled air circulations elements (24). The present invention typically makes use of said existing elements, thereby making the present invention economical to practice. The soil beneath the house, which provides the soil gas pressure which is sensed by the open end of tube (22) is identified by the numeral (31).

The present invention uses the soil gas pressure as a relatively constant, approximate atmospheric pressure representing, value to which the inside air pressure sensed by the open end of tube (21) or equivalent is compared. The device (20) typically produces a signal which is proportional to the difference of the two identified sensed pressures. Said signal is used to control the rate at which inlet air blower (14) operates. During normal conditions the inlet air blower (14) will operate to cause the inside air pressure to be equal to, or just in excess of, the soil gas pressure. As the pressure inside the house decreases because of the operation of an appliance exhaust blower etc., the inlet air blower (14) in the invention inlet air duct system (12) is caused to alter operations so as to cause a greater volume of air to enter the house and thereby cause the inside pressure to again be equal to, or just in excess of, the soil gas pressure. A change in outside air flow volume rate into a house can be achieved by changing the speed of a blower, the pitch of fan blades, the diversion of air flow or any equivalent means. As this relationship is kept constant by the action of the control system, it will be appreciated that soil gas and the radon it contains will never be at a pressure in excess of that air pressure inside the house, (except possibly transitively before the system can react), and hence, very little soil gas will enter the house. Also note that during the operation of the inlet air blower (14), the heating and air conditioning blower fan (18) continues to circulate air throughout the house. If the incoming air requires heating or cooling said blower fan (18) will operate at a fast speed, and if not, at a slower speed. The device (20) provides a signal to the inlet air blower (14) causing it to speed up or slow down as required to maintain indoor air pressure within a range set by the user.

It will be appreciated that the present invention uses a relatively stable reference pressure, (e.g. soil gas pressure). As such the control system is not subject to destabilizing quick changes in reference signals as are commonly experienced by control systems which are exposed to the wind. Also, as the present invention system typically acts to supply just sufficient air to keep inside air pressure equal to, or just in excess of, soil gas pressure, there are no periods of time when excess and unnecessarily large air volumes are required to be heated or cooled, thereby wasting energy. Again, as the soil gas pressure is the reference, and inside air pressure is set equal to, or just in excess of same, very little soil gas containing radon can enter the house when the invention system is operated in a typical manner.

It is important that while the foregoing describes the invention as it will typically operate, the possibility exists that a user could set the base outside air volume flow rate so that the inside air pressure is less than the soil gas pressure, and hence, possibly very nearly just equal to average outside atmospheric pressure. This follows as normally the outside atmospheric pressure is lower than soil gas pressure. While such operation of the invention would not be typical, in leaky houses it might be optimum in that an outside air volume flow rate lower than that necessary to keep the inside air pressure equal to, or just in excess of, the soil gas pressure is not required to provide a healthy environment inside the house. Tightly sealing some houses is prohibitively expensive. While radon gas can enter a house when the invention is operated as such, because the pressure therein is less than the soil gas pressure, the air volume flow rate might be sufficient to significantly dilute any entering radon and prevent its accumulation to dangerous concentration levels. The lower air volume flow rate would translate into greater energy savings as less outside air would have to be heated or cooled, and more existing, already heated or cooled, inside air would be simply recirculated for longer periods of time. It will be understood then, that the device (20) can provide a basic user selected outside air volume flow rate when the inside air pressure is less that the soil gas pressure, and prevent indoor air pressure from becomming significantly lower than atmospheric pressure. The control system range of adjustment can accommodate such operation.

As an added feature, some houses may include a separate added active exhaust blower, (not shown), and vent system which serves to cause air to leave a house. Such would typically be used in a house which has no appliances which normally perform such a function. Operation of the active exhaust blower would activate the inlet air blower (14) and the system will operate and respond as already described. Note, however, that in most cases a separate active exhaust blower will not be added to a house as the user can simply adjust the base level of air volume flow rate provided by inlet air blower (14) to provide the operation of the invention system at a desired outside air volume flow rate, with stale air naturally exiting by way of the fireplace chimney or other open passive exhaust vent.

As alluded to earlier, soil gas pressure is normally slightly higher than average outside atmospheric pressure, from which it typically differs by a relatively constant value. As a result, typical operation of the invention system will naturally lead to inside air pressure being higher than outside air pressure. As a result air will tend to naturally and passively flow out of all open house exhaust vents. It can happen, however, that wind can intermittantly cause the outside upwind air pressure to rise above the inside air pressure, and an inverted air flow situation would then occur in which air flows passively into the house through the open exhaust vents. For this reason, it is within the scope of the present invention, to place check valves on open exhaust vents such that air can flow out of the exhaust vents, but not enter. Such an inversion of air pressure as identified would then cause the inside air pressure to rise passively as a result of air flow into the house through the inlet air duct system (12), (and any remaining cracks), only. When the wind subsides and the outside air pressure again becomes less than the inside air pressure, the invention will, of course, allow air to passively leave the house and the normal operation of the invention system, as described above, will resume. Thus, even in situations in which the upwind exterior air pressure against the house exceeds the inside air pressure, if check valves are installed as described and most cracks have been sealed, air will enter by way of the inlet air duct system (12) and be subject to the air filtering and temperature adjusting process before being circulated in the house by the furnace and air conditioning system (17).

Proper utilization of the present invention then provides an energy efficient, healthy inside environment for occupants. The energy efficiency will, however, be a function of the percentage of cracks which are sealed in a house, (i.e. the tightness of the house), and of proper house insulation, in addition to the the benefits provided by the present invention system and method of use.

As a closing comment it is important to emphasise that the term "tight", as used in this disclosure, is a relative term, and relates to the optimum operating condition of the system of the present invention. A tight house is defined as one in which the act of bringing in a minimum of outside air for the number of occupants will cause the air pressure inside the house to be greater than the soil gas pressure. The term tight shall not be taken to represent any specific level of sealed cracks or remaining open cracks, as the term is used herein and specifically as used in the claims. New homes can be constructed to be very tight. Some older homes can not, however, with reasonable expense, be tightly sealed.

Finally, while a house was used as an example in the foregoing, any other building can be fitted with the present invention.

Having hereby disclosed the subject matter of this invention, it should be obvious that many modifications and substitutions and variations of the present invention are possible in light of the teachings. It is therefore to be understood that the invention may be practiced other than as specifically described, and should be limited in breadth and scope only by the claims.

I claim:

1. A ventilation system for use in a house or building, which house or building sets upon a foundation atop of underlying soil and is equipped with a heating and air conditioning system comprised of a cold air return, a blower fan and a high efficiency particulate filter; which ventilation system comprises, in combination with the heating and air conditioning system, a series combination of a prefilter and an inlet air blower, which prefilter and inlet air blower are attached to one another by way of a common duct, which common duct, at one end thereof, has access to the atmosphere outside the house or building, and which common duct, at the other end thereof, attaches to the cold air return of the heating and air conditioning system of the house or building; which house or building heating and air conditioning system is fashioned such that essentially all air entering the cold air return passes through the high efficiency particulate filter and and is caused by the blower fan of the heating and air conditioning system to circulate through the house or building and either leave through an opening in the house or building, such as an open door or window or by way of an exhaust fan, or return to the cold air return; which ventilation system further comprises a pressure difference monitoring sensor, which pressure difference monitoring sensor monitors the air pressure inside the house or building and also monitors soil gas pressure beneath the foundation of the house or building without significantly altering said soil gas pressure; which pressure difference monitoring sensor produces a signal which is proportional to the difference between the two identified pressures, which signal is used to regulate the operation of the inlet air blower so as to increase air volume flow rate when the air pressure in the house or building is at a level, when compared to the soil gas pressure, lower than a user selected level, so that the air pressure inside the house or building is increased, and to again operate at a reduced air volume flow rate when the air pressure inside the house or building is at, or above, the user selected level with respect to the soil gas pressure.

2. A ventilation system as in claim 1 in which the heating and air conditioning blower fan is set to continually operate so that no less than a desired minimum volume of filtered air flow recirculates through the house or building, and which heating and air conditioning blower fan operates so as to cause a higher volume of filtered air flow during the operation of heating or cooling systems.

3. A house or building, which house or building sets upon a foundation atop of underlying soil and is equipped with a heating and air conditioning system comprised of a cold air return, a blower fan and a high efficiency particulate filter; which house or building also includes a ventilation system, which ventilation system comprises, in combination with the heating and air conditioning system, a series combination of a prefilter and an inlet air blower, which prefilter and inlet air blower are attached to one another by way of a common duct, which common duct, at one end thereof, has access to the atmosphere outside the house or building, and which common duct, at the other end thereof, attaches to the cold air return of the heating and air conditioning system of the house or building; which house or building heating and air conditioning system is fashioned such that essentially all air entering the cold air return passes through the high efficiency particulate filter and and is caused by the blower fan of the heating and air conditioning system to circulate through the house or building and either leave through an opening in the house or building, such as an open door or window or by way of an exhaust fan, or return to the cold air return; which ventilation system further comprises a pressure difference monitoring sensor, which pressure difference monitoring sensor monitors the air pressure inside the house or building and also monitors soil gas pressure beneath the foundation of the house or building without significantly altering said soil gas pressure; which pressure difference monitoring sensor produces a signal which is proportional to the difference between the two identified pressures, which signal is used to regulate the operation of the inlet air blower so as to increase air volume flow rate when the air pressure in the house or building is at a level, when compared to the soil gas pressure, lower than a user selected level, so that the air pressure inside the house or building is increased, and to again operate at a desired minimum air volume flow rate when the air pressure inside the house or building is at or above the user selected level with respect to the soil gas pressure.

4. A house or building as in claim 3 in which the heating and air conditioning blower fan is set to continually operate so that a constant minimum volume of recirculating filtered air flow occures through the house or building, and which heating and air conditioning blower fan operates so as to cause a higher volume of filtered air flow during the operation of heating or cooling systems.

5. A method of economically ventilating a house or building to provide a healthy environment therein comprising the steps of:

a. fitting the house or building, which house or building sets upon a foundation atop of underlying soil and is equipped with a heating and air conditioning system comprised of a cold air return, a blower fan and a high efficiency particulate filter; with a ventilation system, which ventilation system comprises, in combination with the heating and air conditioning system, a series combination of a prefilter and an inlet air blower, which prefilter and inlet air blower are attached to one another by way of a common duct, which common duct, at one end thereof, has access to the atmosphere outside the house or building, and which common duct, at the other end thereof, attaches to the cold air return of the heating and air conditioning system of the house or building; which house or building heating and air conditioning system is fashioned such that essentially all air entering the cold air return passes through the high efficiency particualte filter and and is caused by the blower fan of the heating and air conditioning system to circulate through the house or building and either leave through an opening in the house or building, such as an open door or window or by way of an exhaust fan, or return to the cold air return; which ventilation system further comprises a pressure difference monitoring sensor, which pressure difference monitoring sensor monitors the air pressure inside the house or building and also monitors soil gas pressure beneath the foundation of the house or building without significantly altering said soil gas pressure; which pressure difference monitoring sensor produces a signal which is proportional to the difference between the two identified pressures, which signal is used to regulate the operation of the inlet air blower so as to increase air volume flow rate when the air pressure in the house or building is at a level, when compared to the soil gas pressure, lower than a user selected level, so that the air pressure inside the house or building is increased, and to again operate at a reduced air volume flow rate when the air pressure inside the house or building is at or above the user selected level with respect to the soil gas pressure;

b. setting the heating and air conditioning system blower fan to continually operate so that a minimum recirculating air flow and constant air filtration will occur in the house or building, and which heating and air conditioning blower fan can be operated so as to cause a higher air volume flow rate during operation of heating or cooling systems;

c. setting the pressure difference monitor sensor, the signal developed thereby which acts to control the inlet air blower, so that the inlet air blower operates at some user selected level to cause some level of inlet air volume flow rate from the outside of the house or building to be continually entered into the cold air return of the heating and air conditioning system of the house or building, which level of inlet air is sufficient to maintain a healthy environment inside the house or building;

d. allowing the ventilation system to operate so that when air inside the house or building is expelled through leaks such as present around windows and doors or through chimneys or exhaust fans etc., then the inlet air blower is caused, by a change in the signal from the pressure difference monitor sensor, to operate so as to cause an increased volume of air to flow into the cold air return of the heating and air conditioning system and thereby reestablish the relaionship between the air pressure inside the house or building and the soil gas pressure which was set in step c above, unitl said increased volume of air flow is no longer required to maintain the identified relationship between air pressure inside the house or building and the soil gas pressure, at which time the inlet air blower is again caused by the signal from the pressure difference monitor sensor to operate so as to provide the minimum air volume flow rate set by the user.

* * * * *